US012325608B2

(12) United States Patent
Lucia et al.

(10) Patent No.: US 12,325,608 B2
(45) Date of Patent: Jun. 10, 2025

(54) APPARATUS AND METHOD FOR DISPENSING SECTIONS OF DOUBLE-SIDED ADHESIVE TAPE

(71) Applicants: Fameccanica.Data S.p.A., San Giovanni Teatino (IT); Fondazione Istituto Italiano di Tecnologia, Genoa (IT)

(72) Inventors: Oronzo Lucia, San Giovanni Teatino (IT); Alessandro Cipriani, San Giovanni Teatino (IT); Maurizio Spiriticchio, San Giovanni Teatino (IT); Khelifa Baizid, Genoa (IT); Emanuela Elisa Cepolina, Genoa (IT); Massimiliano Scaccia, Rome (IT); Roberto Gagliardi, San Benedetto del Tronto (IT); Mariapaola D'Imperio, Cittadella (IT); Isiah Zaplana, Genoa (IT); Ferdinando Cannella, Genoa (IT); Darwin G. Caldwell, Serra Riccò (IT)

(73) Assignees: Fameccanica.Data S.p.A., San Giovanni Teatino Chieti (IT); Fondazione Istituto Italiano di Tecnologia, Genoa (IT)

( * ) Notice: Subject to any disclaimer, the term of this patent is extended or adjusted under 35 U.S.C. 154(b) by 599 days.

(21) Appl. No.: 17/505,839

(22) Filed: Oct. 20, 2021

(65) Prior Publication Data

US 2022/0119216 A1 Apr. 21, 2022

(30) Foreign Application Priority Data

Oct. 21, 2020 (IT) ..... 102020000024892

(51) Int. Cl.
*B65H 35/00* (2006.01)
*B65H 35/06* (2006.01)
*B65H 37/00* (2006.01)

(52) U.S. Cl.
CPC ..... *B65H 35/0086* (2013.01); *B65H 35/0066* (2013.01); *B65H 35/06* (2013.01); (Continued)

(58) Field of Classification Search
CPC .. B65H 37/02; B65H 37/002; B65H 35/0093; B65H 35/0026; B65H 35/002; B65H 35/006; B65H 35/0066
See application file for complete search history.

(56) References Cited

U.S. PATENT DOCUMENTS 4,346,550 A * 8/1982 Ferree ..... H01B 13/0808 242/442
4,608,110 A 8/1986 Smith
(Continued)

FOREIGN PATENT DOCUMENTS

CN 101466908 A 6/2009
JP S60197565 A 10/1985

OTHER PUBLICATIONS

Search Report dated Jul. 8, 2021. 12 pages.
Chinese Office Action dated May 10, 2023. 11 pages.

*Primary Examiner* — Alex B Efta
(74) *Attorney, Agent, or Firm* — RMCK Law Group PLC

(57) ABSTRACT

An apparatus and a method for dispensing discrete sections of double-sided adhesive tape, comprising a reel support unit whose position is adjustable so as to vary a length of the section of double-sided adhesive tape to be dispensed.

8 Claims, 8 Drawing Sheets

(52) U.S. Cl.
CPC . *B65H 37/002* (2013.01); *B65H 2301/51532* (2013.01); *B65H 2701/3772* (2013.01)

(56) References Cited

U.S. PATENT DOCUMENTS

| | | | | | |
|---|---|---|---|---|---|
| 4,707,214 | A * | 11/1987 | Nithart | H01B 13/0883 | 156/499 |
| 4,867,833 | A * | 9/1989 | McCoy | B65C 9/42 | 156/542 |
| 5,478,000 | A * | 12/1995 | Jensen | B65H 35/0066 | 83/337 |
| 2007/0125474 | A1 | 6/2007 | Barker et al. | | |
| 2022/0135361 | A1* | 5/2022 | Verrall | B65H 35/006 | 156/64 |

* cited by examiner

APPARATUS AND METHOD FOR DISPENSING SECTIONS OF DOUBLE-SIDED ADHESIVE TAPE

CROSS-REFERENCE TO RELATED APPLICATION

This application claims priority to Italian Patent Application No. 102020000024892 filed Oct. 21, 2020. The disclosure of the above application is incorporated herein by reference in its entirety.

FIELD OF THE INVENTION

The present invention relates to an apparatus and a method for dispensing discrete sections of double-sided adhesive tape.

The invention has been developed, in particular, regarding its application to the field of producing sanitary articles, such as sanitary absorbent towels, baby diapers, panty diapers, diapers for incontinent adults, bandages, face protection masks, packaging, etc.

However, the invention can be used in all sectors where the need arises to automatically dispense discrete sections of double-sided adhesive tape.

DESCRIPTION OF THE RELATED ART

In machines for producing sanitary articles large quantities of web materials (for example, non-woven fabrics) contained in reels are used.

Modern machines for producing sanitary articles operate at increasingly higher speeds, so that the unwinding speed of the web materials from the reels tends to an ever-increasing growth, increasing the frequency with which finished reels have to be replaced with new reels.

Replacing a finished reel with a new reel must be carried out by maintaining continuity between the web material coming from the reel close to finishing and the web material coming from the new reel, so as not to interrupt the operation of the machine.

The continuity of the web material is obtained by making a joint between the tail portion of the web that is unwinding from a reel close to finishing with the leading portion of a web wound on a new reel.

In order to quickly and automatically make the joint of the reels on the unwinding assemblies, it is necessary to preliminarily carry out an adequate preparation of the leading edges of the new reels.

Preparing the edges of the reels consists in removing a leading section of the new reel which is usually soiled or damaged and in applying onto the leading end of the web of the new reel a section of double-sided adhesive tape, which is used for joining the leading section of the web material of a new reel with the tail section of the web material of a reel close to finishing.

Double-sided adhesive tapes are supplied in reels with an undefined length and consist of a support provided with two layers of adhesive on both the faces. A thin support film is applied onto the external adhesive layer so as to prevent the external adhesive layer from sticking to the inner adhesive layer of the successive turn. The double-sided adhesive tape is cut in discrete sections having the desired length and the side opposite to the one bearing the film is applied onto the application surface. Therefore, the film is removed so as to present the adhesive on the external side of the web. Since double-sided adhesive tapes are sticky on both sides, automating the step of cutting, applying and removing the film is very complex. In many industrial plants the step of applying the sections of double-sided adhesive tape is still done manually.

U.S. Pat. No. 3,765,992 describes a mechanism for transferring a predetermined length of double-sided adhesive tape onto objects starting from a continuous web carried by a detachable film. The device includes means for cutting the double-sided adhesive tape for forming a discrete section of a predetermined length and placing then the discrete sections onto an application surface by means of a pressing element. The length of the sections of double-sided adhesive tape to be dispensed is always fixed. In case a section having a high length of double-sided adhesive tape has to be applied onto very thin webs, there is the risk that the double-sided adhesive tape remains adherent to the film instead to the application surface or that the thin web is damaged during the separation of the film.

EP0755890 B1 describes a mechanism for automatically applying sections of double-sided adhesive tape onto an object, which operates in a similar way to the device of U.S. Pat. No. 3,765,992 and is affected by the same drawbacks.

JP2000302316 A describes a structure that supports a double-sided adhesive tape and evacuates the film separated from the double-sided adhesive tape outwards. In this case also, the length of the section of double-sided adhesive tape remains constant.

JP4678733 B2 describes a dispenser of double-sided adhesive tape wherein a layer of double-sided adhesive tape can be applied onto a pressing member so as to be applied in the form of dots or lines having a predetermined length. A gear mechanism drives a device that dispenses a defined length of the double-sided adhesive tape. The adhesive layer of the tape is formed by cuts at adequate spacings along the longitudinal direction of the double-sided adhesive tape, which makes the device specific to certain types of double-sided adhesive tapes and unfitted to standard double-sided adhesive tapes. Additionally, in case the required length is greater than the one of the spacings of the double-sided adhesive tape, a discontinuity of the double-sided adhesive tape is created that involves quality problems.

KR101297640 B1 describes a dispenser of tape, having a rolling function and a pressing function, that can be used for joining operations. The device can carry out a rolling operation while it dispenses and withdraws a tape coated with adhesive. It is possible to selectively use the rolling and pressing by manually pressing a button. The movement inside the device is manual and it is based on the pressure applied by the operator. The device is suited for manual operations without predefining the length of the double-sided adhesive tape. Additionally, the device is poorly precise and it is suited for applying double-sided adhesive tape onto strong materials, as, for example, cardboard, but it is not suited for application onto ultra-thin materials.

OBJECT AND SUMMARY OF THE INVENTION

The object of the present invention is to provide an apparatus and a method for dispensing discrete sections of double-sided adhesive tape that overcome the problems of the prior art.

According to the present invention, this object is achieved by an apparatus and a method having the characteristics forming the subject of the claims.

The present invention provides a reconfigurable dispenser of double-sided adhesive tape which allows the user to set the required length of the section of double-sided adhesive tape to be dispensed. The length of the tape section can be set by varying the position of the cutting zone of the double-sided adhesive tape. In a possible embodiment, the cutting unit is mounted on a rotatable support that carries the reel of double-sided adhesive tape. The adjustment of the length of the tape section can be set by varying the angular position of the rotatable support.

The application of the section of tape can be carried out onto surfaces of various, both soft and hard, nature without risks of material damaging during the separation of the film from the double-sided adhesive tape.

BRIEF DESCRIPTION OF THE DRAWINGS

Further characteristics and advantages of the present invention will be evident in the following detailed description, given purely by way of non-limiting example, wherein.

It will be appreciated that the various figures may not be represented on the same scale and that some components may be omitted for easier understanding of the figures.

DETAILED DESCRIPTION

Figure 1:
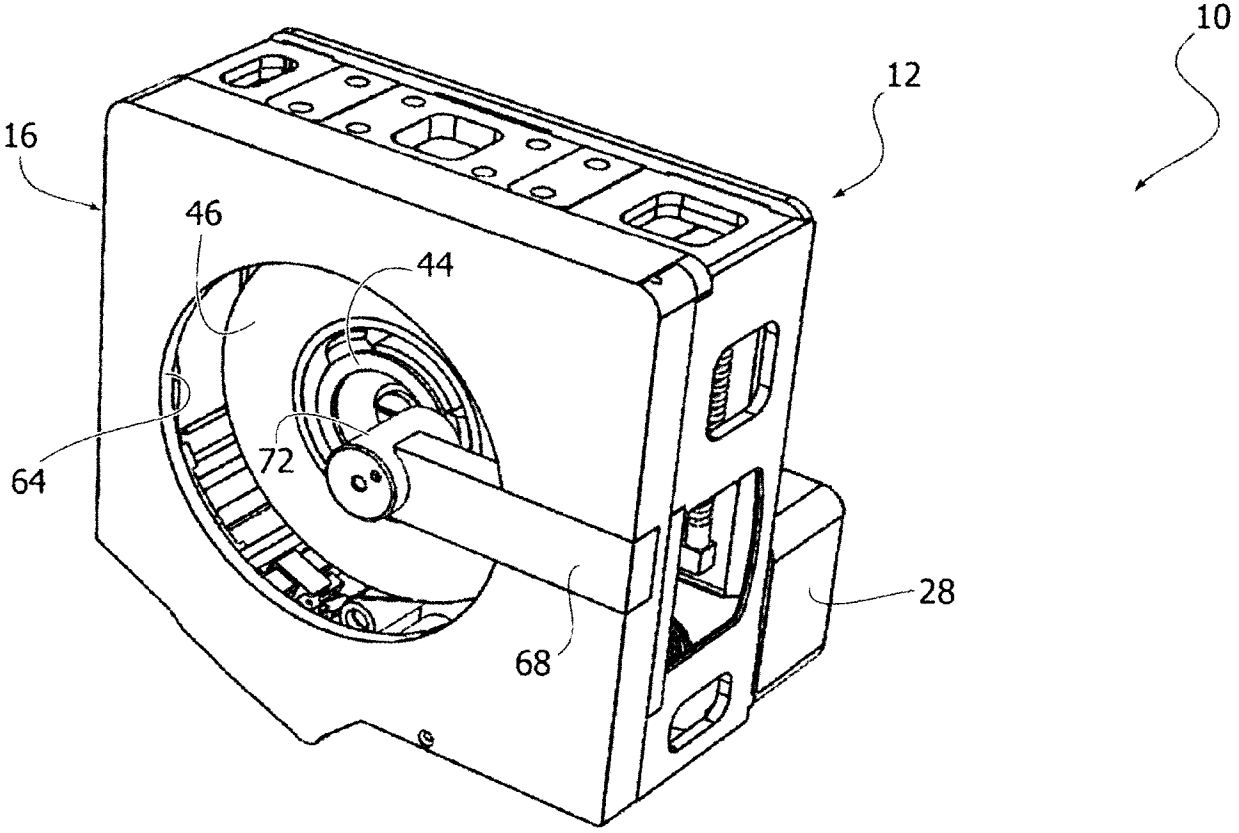
FIG. 1 is a perspective view of an apparatus according to the present invention.
Figure 2:
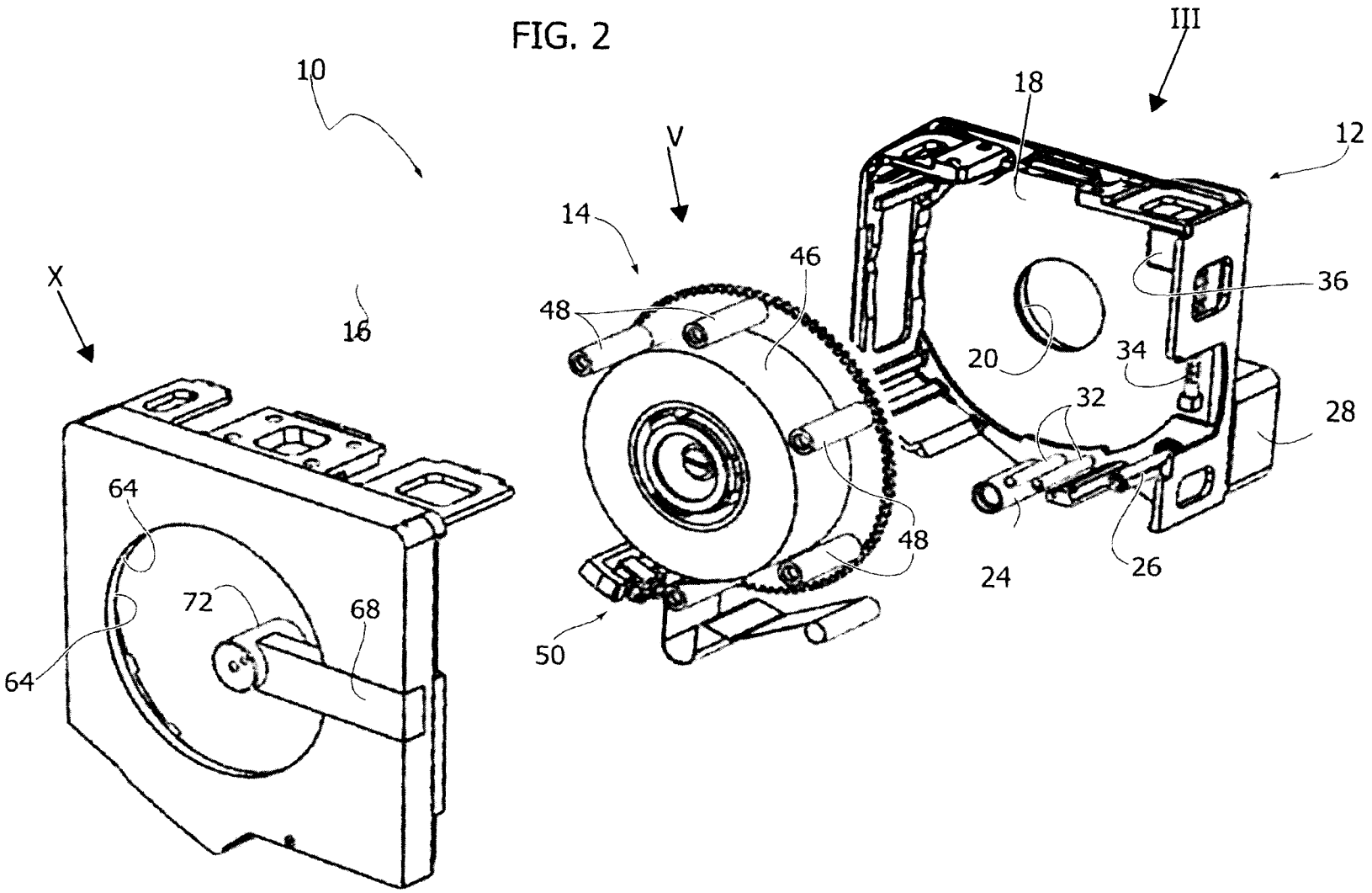
FIG. 2 is an exploded perspective view of the apparatus of FIG. 1.

With reference to FIGS. 1 and 2, numeral 10 indicates an apparatus for automatically dispensing discrete sections of double-sided adhesive tape with a desired length and for applying the discrete sections of double-sided adhesive tape onto an application surface (not shown).

With reference to FIG. 2, the apparatus 10 comprises a casing 12, a reel support unit 14, and a lid 16.

Figure 4:
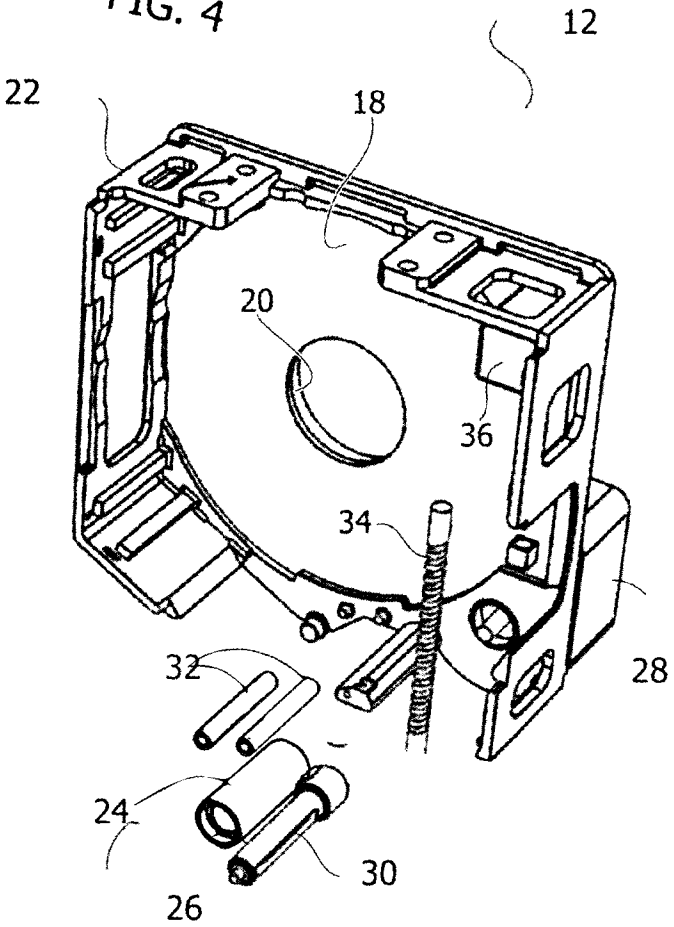
FIG. 4 is an exploded perspective view of the component illustrated in FIG. 3.
Figure 3:
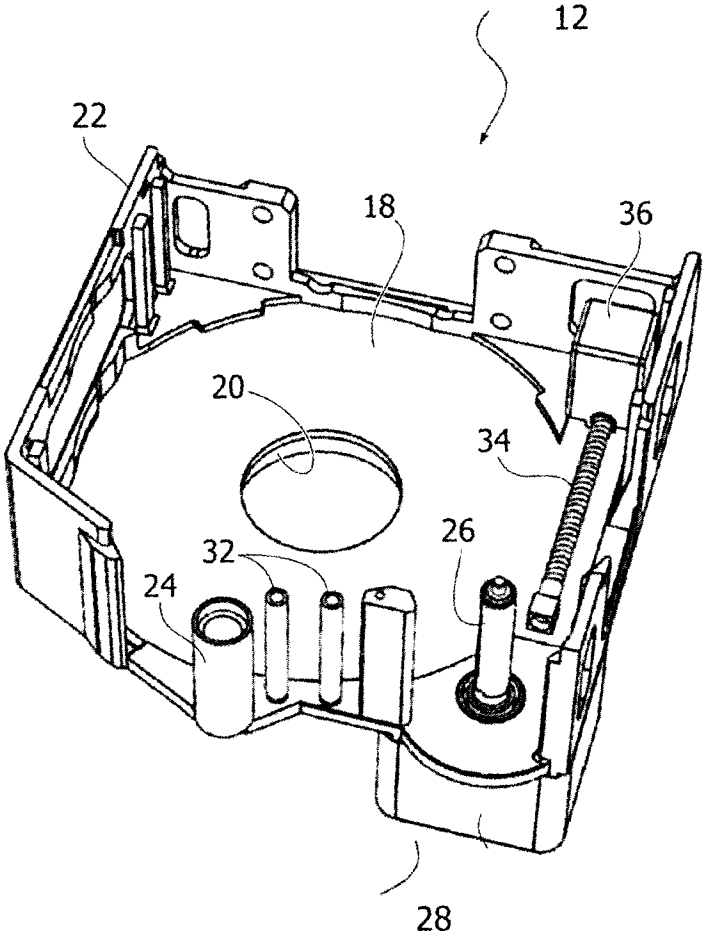
FIG. 3 is a perspective view of the part indicated by the arrow III in FIG. 2.
Figure 6:
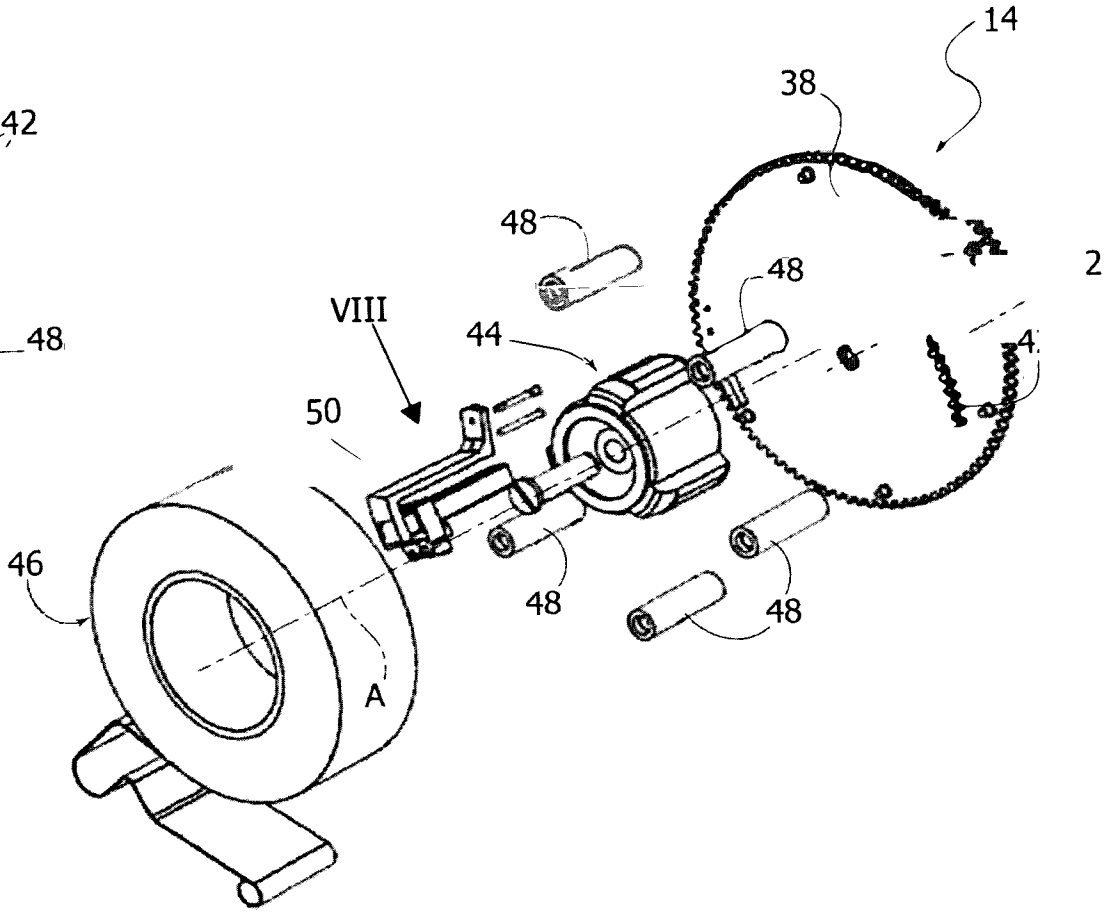
FIG. 6 is an exploded perspective view of the components illustrated in FIG. 5.
Figure 5:
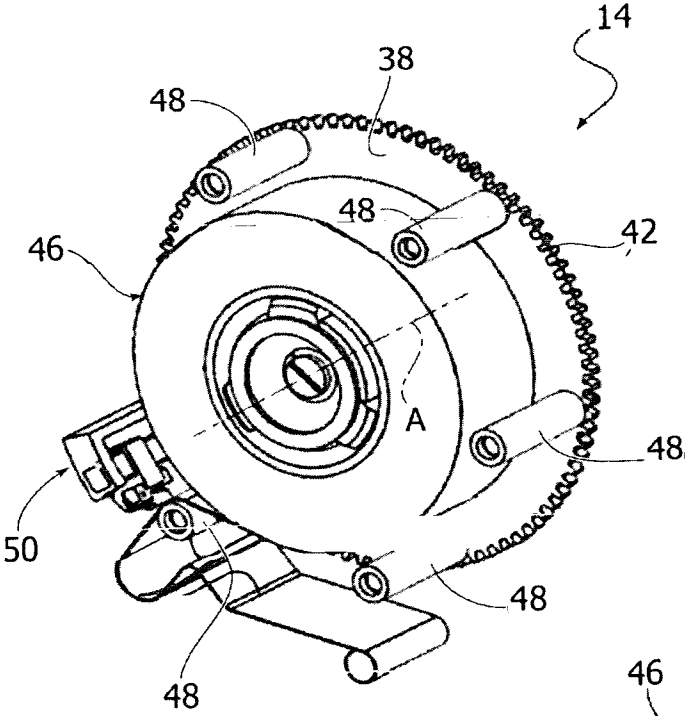
FIG. 5 is a perspective view on a larger scale of the portion indicated by the arrow V in FIG. 2.

With reference to FIGS. 3 and 4, the casing 12 comprises a rear wall 18 having a central hole 20 and a side wall 22. The casing 12 carries an applicator roller 24 extending orthogonal to the rear wall 18 and idle around its own axis. The applicator roller 24 is configured to press a section of double-sided adhesive tape against an application surface.

The casing 12 comprises a winding pin 26 carried by the rear wall 18 and parallel to the applicator roller 24. The winding pin 26 is driven into rotation by means of an electric motor 28 and it is configured to wind a support film that is detached from the double-sided adhesive tape. The winding pin 26 can be provided with a slot 30 within which the end of the support film can be inserted to facilitate winding the support film onto the winding pin 26. The casing 12 may comprise one or more guiding rollers 32 parallel to the applicator roller 24 and to the winding pin 26 and arranged to guide the support film onto the winding pin 26.

The casing 12 comprises also an adjustment screw 34 driven into rotation by means of an electric motor 36. In the illustrated embodiment, the adjustment screw 34 can be oriented orthogonal relative to the axes of the applicator roller 24 and winding pin 26. In a possible embodiment (not shown), the adjustment screw 34 can be replaced by a gear driven into rotation by a motor having its own rotation axis parallel to the axes of the applicator roller 24 and winding pin 26. As it will become clearer in the following, the adjustment screw 34 (or the gear) is part of an adjustment mechanism configured to adjust the length of the sections of double-sided adhesive tape to be dispensed.

Figure 7:
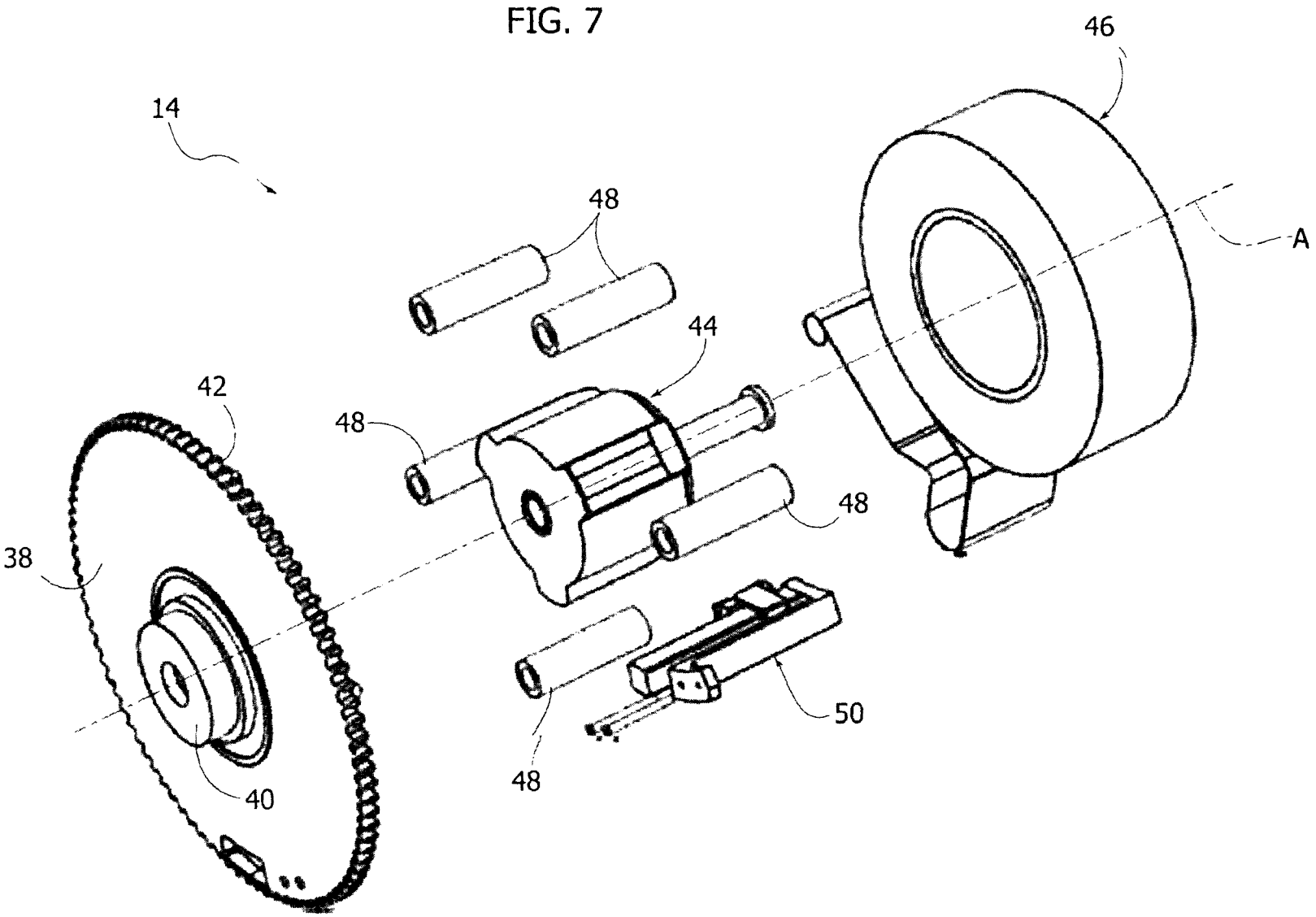
FIG. 7 is an exploded perspective view from a different angle of the components of FIG. 6.

With reference to FIGS. 2 and 5-7, the reel support unit 14 comprises a base plate 38 that is rotatable relative to the casing 12 around an axis A. With reference to FIG. 7, the base plate 38 may have a cylindrical projection 40 rotatably engaging the hole 20 of the rear wall 18 of the casing 12. The base plate 38 may rest on the rear surface 18 of the casing 12. The base plate 38 has a peripheral toothing 42 meshing with the adjustment screw 34. The peripheral toothing 42 of the base plate 38 and the adjustment screw 34 of the casing 12 form an adjustment mechanism which allows adjusting the angular position of the base plate 38 relative to the casing 12 around the axis A.

The base plate 38 carries a hub 44 on which a reel 46 of double-sided adhesive tape is intended to be mounted. The hub 44 is rotatable relative to the base plate 38 around the axis A so as to allow the double-sided adhesive tape to unwind from the reel 46.

The base plate 38 carries a plurality of return pins 48 with respective axes parallel to the axis A. The return pins 48 may be arranged on a circumference surrounding the reel 46.

Figures 8, 9:
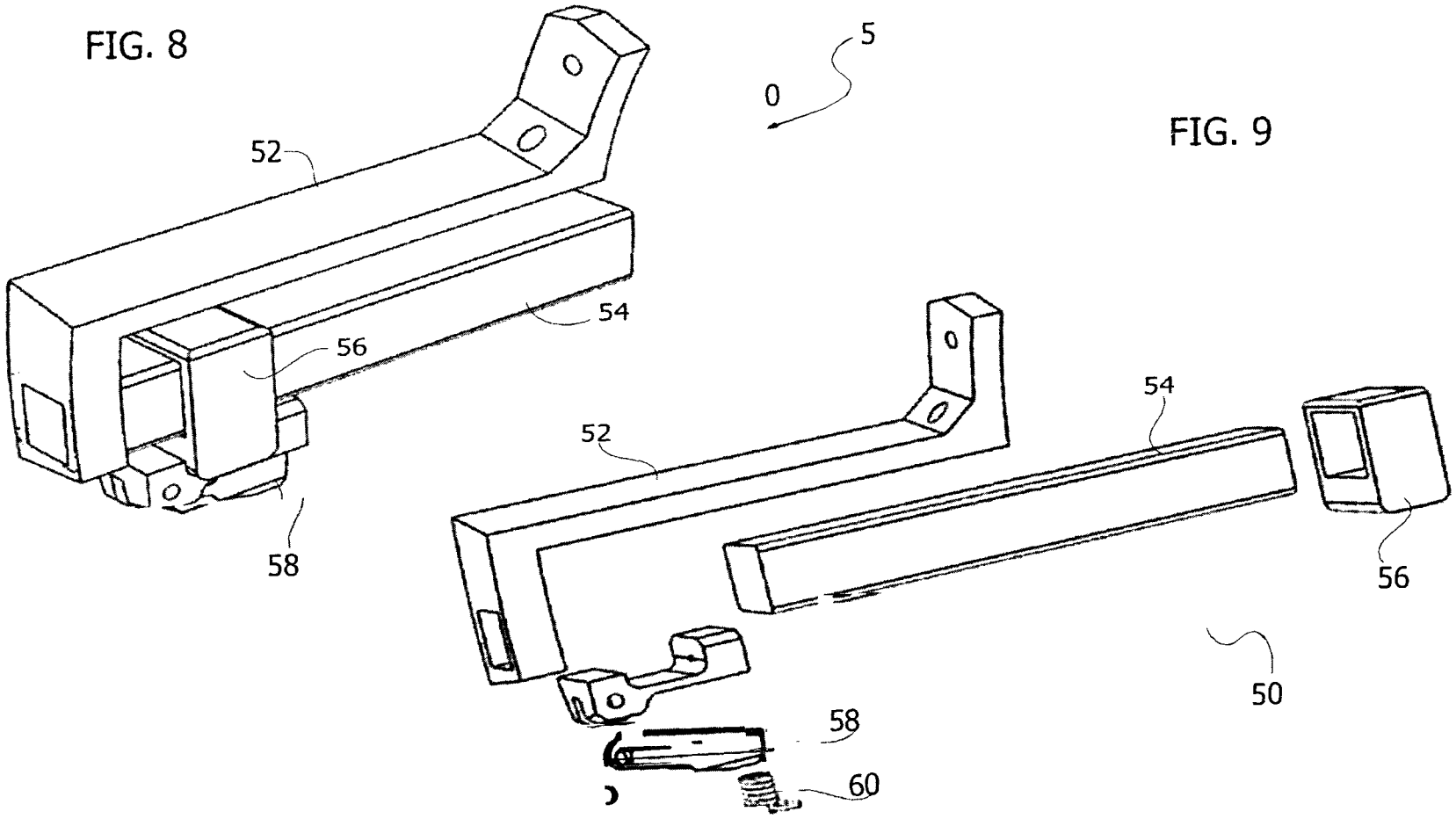
FIG. 8 is a perspective view on a larger scale of the part indicated by the arrow VIII in FIG. 6.
FIG. 9 is an exploded perspective view of the part illustrated in FIG. 8.

With reference to FIGS. 8 and 9, the reel support unit 14 carries a cutting device 50 configured to carry out the transversal cutting of successive sections unwound from the reel 46 of double-sided tape. The cutting device 50 comprises a bracket 52 fixed relative to the base plate 38 and carrying a guide 54 oriented parallel to the axis A. A slider 56 is movable along the guide 54. The movement of the slider 56 along the guide 54 is controlled by an electric actuator (not shown). The slider 56 carries a blade 58 that is pressed elastically, for example, by means of an elastic element 60, toward the tape to be cut. The blade 58 is pressed against the double-sided adhesive tape by a determined force so as to carry out the cutting of the double-sided adhesive tape only without cutting the support film applied to the external surface of the double-sided adhesive tape. The cutting of the double-sided adhesive tape is carried out by a cutting movement along a transverse rectilinear direction, which improves the effectiveness and quality of cutting relative to known solutions that use rotating cutting blades.

Figure 10:
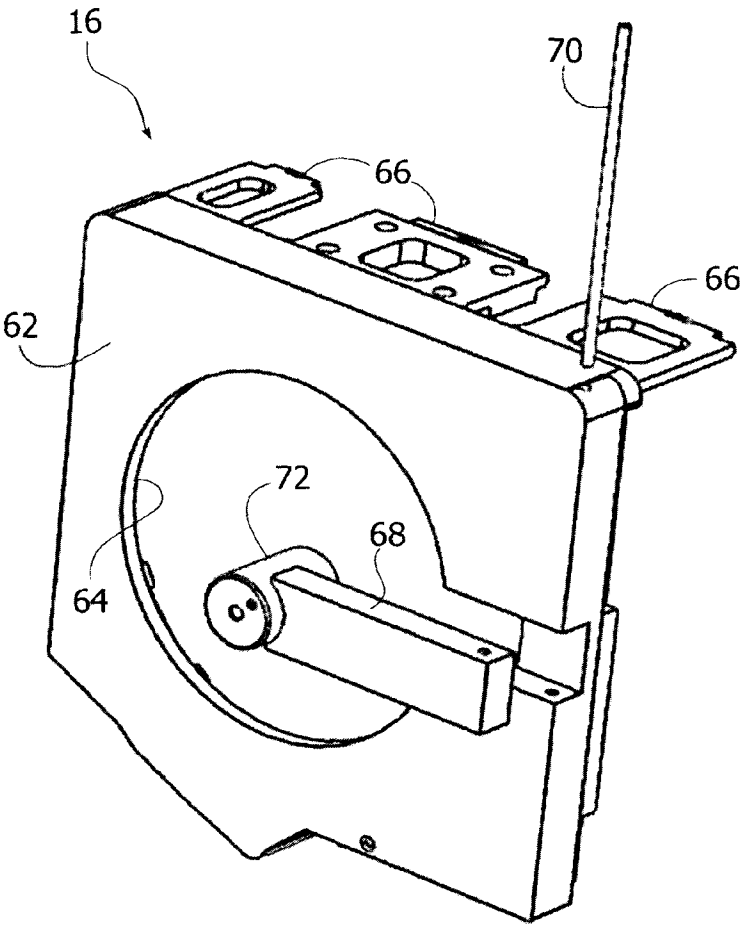
FIG. 10 is an exploded perspective view of the part indicated by the arrow X in FIG. 2.

With reference to FIG. 10, the lid 16 comprises a front wall 62 having an opening 64 sized so as to allow the passage of a reel 36 of double-sided adhesive tape. The lid 16 is connected to the casing 12 by means of connecting features 66 which engage corresponding connecting features formed on the side wall 22 of the casing 12. Screws may also be provided so as to secure the lid 16 to the casing 12.

The lid 16 may comprise an arm 68 articulated to the front wall 62 by means of a pin 70. The arm 68 carries a magnet 72 located at the center of the opening 64 that acts on a metal ring located at the front end of the hub 44 of the reel support unit 14. The magnet 72 holds the hub 44 to prevent undesired rotation movements of the reel 46. The magnet 72 still allows the rotation of the hub 44 and reel 46 mounted thereon when the double-sided adhesive tape is positively unwound from the reel 46. The arm 68 articulated to the front wall 62 of the lid 16 allows the opening 64 to be released so as to replace the reel 46 without necessity of removing the lid 16.

Figure 11:
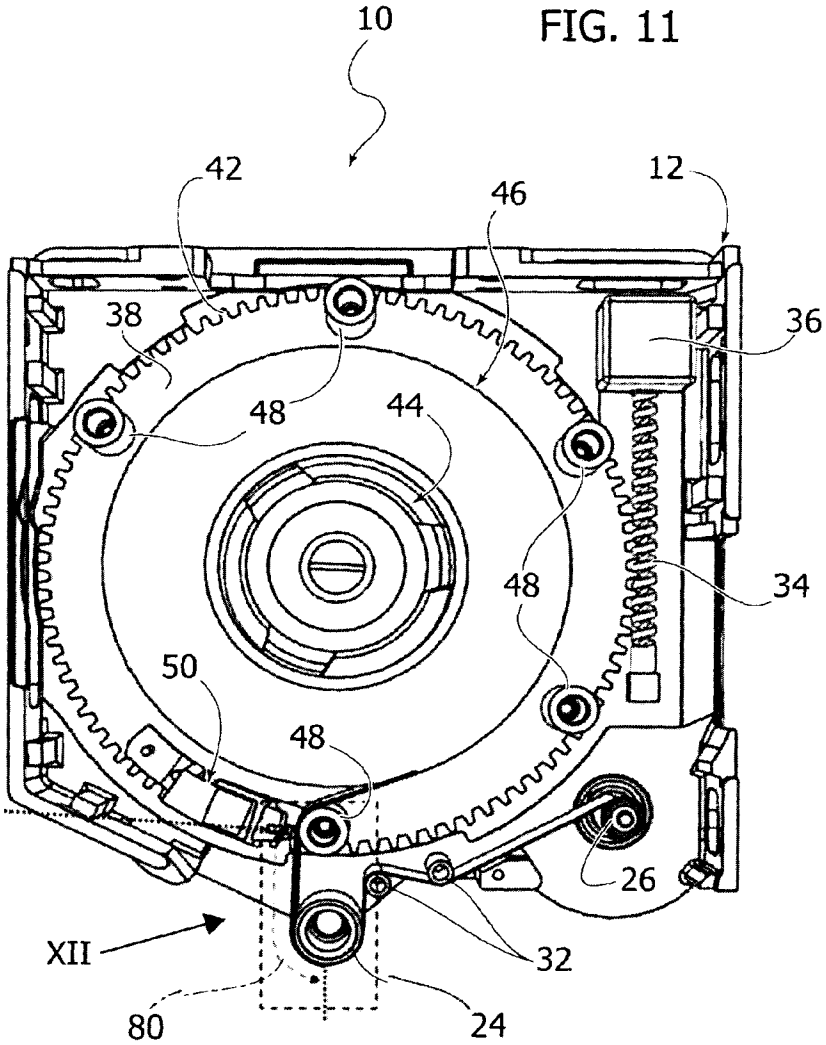
FIG. 11 is a front view showing the operation of the apparatus according to the invention in a first configuration.
Figure 13:
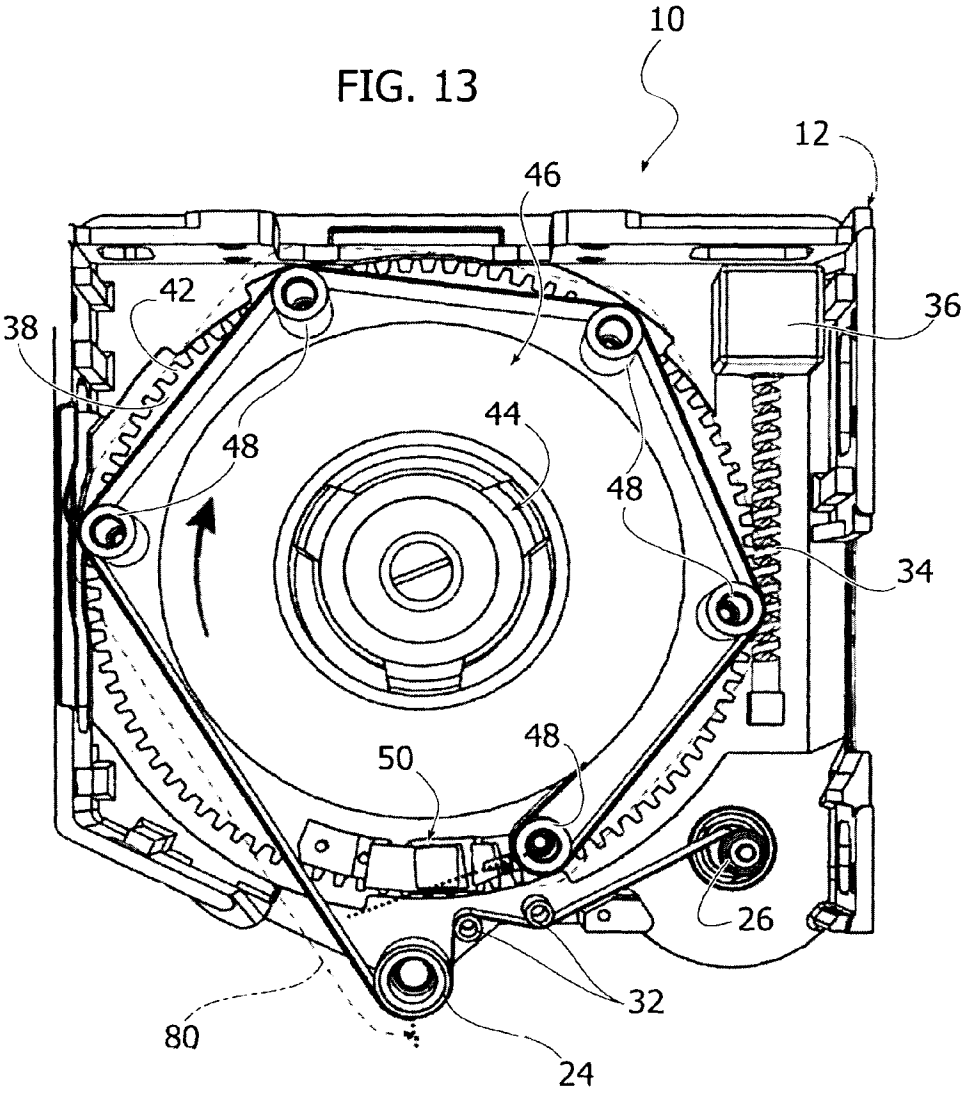
FIG. 13 is a front view showing the operation of the apparatus according to the invention in a second configuration.
Figure 12:
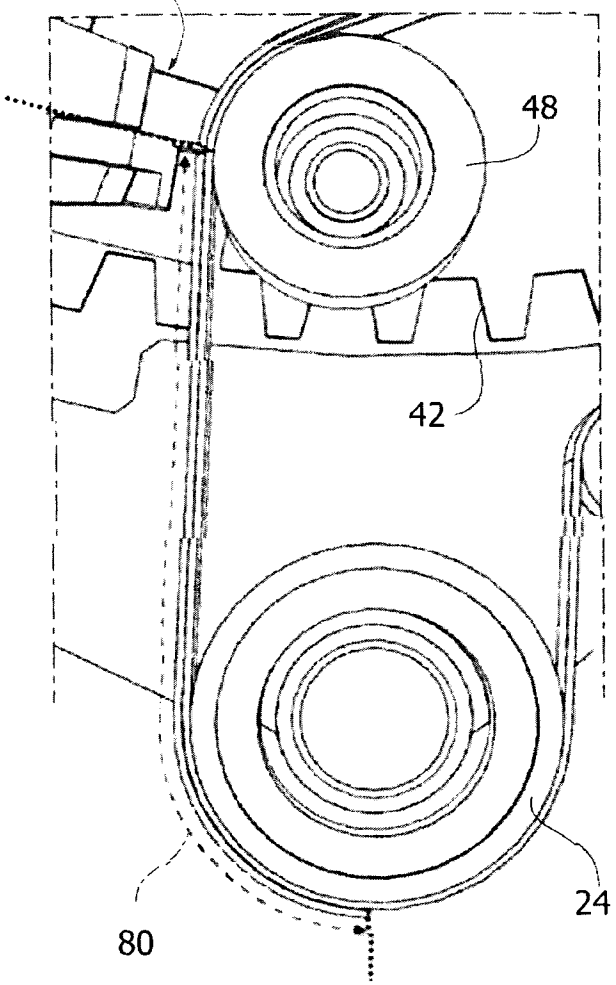
FIG. 12 is an enlarged detail of the part indicated by the arrow XII in FIG. 11.

The operation of the apparatus 10 according to the present invention is shown in FIGS. 11, 12 and 13.

At first, the length of the section of double-sided adhesive tape to be dispensed as desired is set. The selection of the length of the tape to be dispensed is carried out by controlling the rotation of the whole reel support unit 14 around to the axis A by means of the motor 36 and of the screw 34 meshing with the peripheral toothing 42 of the base plate 38 of the reel support unit 14. The rotation of the base plate 38 around the axis A varies the angular position of the cutting device 50 relative to the casing 12 and therefore relative to the applicator roller 24.

In a possible embodiment, the reel support unit 14 might be shiftable relative to the casing along a transversal direction relative to the axis A and the adjustment of the length of the tape to be dispensed may be carried out by controlling the translation of the reel support unit 14 along said transversal direction.

The double-sided adhesive tape that is unwound from the reel 46 passes over one or more return pins 48 carried by the base plate 38 and is guided toward the application roller 24. The film applied onto the external surface of the double-sided adhesive tape detaches from the double-sided adhesive tape at the application roller 24 and, guided by the guiding rollers 32, winds around the winding pin 26.

The cutting unit 50 carries out the transversal cutting of the double-sided adhesive tape, without cutting the support film of the tape. The length of the double-sided adhesive tape to be dispensed corresponds to the length of the section of tape between the line of transversal cutting and the end of the tape located on the applicator roller 24. The length of the section of tape to be dispensed is indicated by the dashed line 80 in FIGS. 11, 12, and 13. FIG. 11 shows the configuration of the apparatus 10 which corresponds to the minimum length of the section of double-sided adhesive tape to be dispensed and FIG. 13 illustrates the configuration of the apparatus which corresponds to the maximum length of the section of double-sided adhesive tape to be dispensed. The apparatus 10 allows to set any length of sections of double-sided adhesive tape in between the minimum value shown in FIG. 11 and the maximum value shown in FIG. 13.

After having carried out the cutting of the double-sided adhesive tape at the desired length, the application roller 24 is placed onto the application surface onto which the section of double-sided adhesive tape has to be applied. Therefore, the whole apparatus 10 is moved along a rectilinear direction parallel to the application surface and transversal relative to the axis A. Such movement can be carried out by means of a mechanical hand, for example an anthropomorphic robot.

While the section of double-sided adhesive tape is gradually applied onto the application surface, the support film is detached from the tape and wound onto the winding pin 26. The traction of the support film causes the unwinding of the tape from the reel 46.

When the application of the section of cut tape is ended, the end of a new section of tape is located at the application roller 24. At this point, the transversal cutting is carried out again at the desired length and the process repeats as described above.

From the description above, it is clear that the length of the double-sided adhesive tape to be dispensed is configurable according to needs, which allows various lengths of double-sided adhesive tape to be applied according to needs, without the need for manual interventions.

Another relevant characteristic of the apparatus according to the invention is that the cutting of the tape is carried out by means of a linearly movable sliding blade.

The apparatus according to the invention is particularly compact and allows fully automatic operation.

Of course, without prejudice to the principle of the invention, the details of construction and the embodiments may be widely varied with respect to those described and illustrated here, without departing from the scope of the invention as defined by the claims that follow.

The invention claimed is:

1. An apparatus for dispensing discrete sections of double-sided adhesive tape, comprising:

a casing carrying an applicator roller and a motorized winding pin configured to wind a support film detached from an external surface of the double-sided adhesive tape, a reel support unit comprising:

a base plate, a hub rotatable relative to the base plate and configured to support a reel of double-sided tape, a plurality of return pins carried by the base plate and arranged to guide the double-sided tape unwound from said reel, and a cutting device configured to transversely cut the double-sided tape unwound from the reel and to form successive discrete sections of double-sided tape, and an adjustment mechanism configured to vary a position of said base plate with respect to the casing to vary a length of the discrete sections of double-sided tape to be dispensed.

2. The apparatus according to claim 1, wherein the base plate of the reel support unit is rotatable relative to the casing and wherein said adjustment mechanism is configured to vary an angular position of the base plate with respect to the casing.

3. The apparatus according to claim 2, wherein said adjustment mechanism comprises an adjustment screw carried by the casing and which meshes with a toothing of the base plate.

4. The apparatus according to claim 1, wherein said cutting device comprises a straight guide fixed with respect to the base plate, a slider movable along said guide in a rectilinear direction transversal with respect to the double-sided tape, and a sliding blade carried by said slider.

5. The apparatus according to claim 4, wherein the cutting device comprises an elastic element arranged to elastically press the sliding blade against the double-sided tape with a determined force so as to carry out cutting of the double-sided tape without cutting the support film.

6. The apparatus according to claim 1, wherein said casing comprises a lid provided with an opening sized to allow passage of the reel of double-sided tape.

7. The apparatus according to claim 6, wherein said lid carries a magnet which acts on a front end of said hub.

8. The apparatus according to claim 1, wherein said plurality of return pins are arranged along a circumference surrounding the reel of double-sided tape mounted on said hub.

* * * * *